US005165484A

United States Patent [19]

Chaput

[11] Patent Number: 5,165,484

[45] Date of Patent: Nov. 24, 1992

[54] OIL WELL FIRE EXTINGUISHER HAVING OIL JET DISPERSING SCREENS

[76] Inventor: Victor B. Chaput, 34 St. Joseph Dr., Nashua, N.H. 03060

[21] Appl. No.: 761,428

[22] Filed: Sep. 17, 1991

[51] Int. Cl.[5] ..... A62C 3/06

[52] U.S. Cl. ..... 169/69; 169/48

[58] Field of Search ..... 169/69, 43, 46, 47, 169/48, 49, 52, 91

[56] References Cited

U.S. PATENT DOCUMENTS 3,887,011 6/1975 Dokes et al. ..... 169/69
4,323,118 4/1982 Bergmann ..... 169/69 X

FOREIGN PATENT DOCUMENTS 375455 6/1990 European Pat. Off. ..... 169/48

*Primary Examiner*—Margaret A. Focarino
*Assistant Examiner*—Andrew C. Pike
*Attorney, Agent, or Firm*—David M. Ostfeld

[57] ABSTRACT

A system to extinguish oil well fires includes screens for dispersing an oil jet through the walls of a cylinder by the use of layered mesh screens, resulting in the reduction of the velocity of the oil jet by impact with the screens and the interior wall of the cylinder to a point where it will then flow down the wall of the cylinder by gravity. This system also includes a collar around the cylinder, through which water will be pumped and sprayed on the cylinder through holes formed in the collar and directed at the cylinder. Additional holes may also be formed and may also be formed and directed to the surrounding area to help extinguish any remaining ground fire. This system allows the flame of an oil well fire to go into the cylinder and the combustion in the cylinder will then produce carbon dioxide and water. Carbon dioxide is prevented from escaping by a flapper valve, which seals the cylinder from a rush of external air. Because of the absence of oxygen, any flame entering the cylinder is immediately extinguished, and once the fire is extinguished and the cylinder is removed, the oil well can be capped according to conventional methods.

19 Claims, 6 Drawing Sheets

OIL WELL FIRE EXTINGUISHER HAVING OIL JET DISPERSING SCREENS

BACKGROUND OF THE INVENTION

1. Field of the Invention

This invention relates to oil well fire extinguishers and in particular extinguishers that are wholly surface operated.

2. Prior Art Discussion

The art of extinguishing oil well fires is relatively old and includes swatting such fires and, as televised broadcasting of the attempts to extinguish oil well fires in Kuwait revealed, fire extinguishers that were used in such efforts were open-ended cylinders. See U.S. Pat. No. 4,337,831. Such methods prove ineffective because they do not contain the fire and thus do not reduce the velocity of the oil jet. Another disadvantage of current methods is that they require large amounts of water which has no effect on extinguishing the fire and consequently its use is wasted. As in the case of U.S. Pat. No. 4,337,831, such methods allow the oil jet to continue to flow up through the cylinder and the oil well fire continues to burn. Such patent also uses an open-ended cylinder placed over the fire and fire extinguishing materials are introduced under pressure into the cylinder. Its principal disadvantage is that even with the introduction of fire extinguishing materials under pressure, the velocity of the jet oil flowing through the cylinder is not reduced or dispersed, and the fire continues to burn and as the oil jet exits the cylinder. The oil fire is fed by the available oxygen. As a result, the method used in U.S. Pat. No. 4,337,831 is lacking result effectiveness.

SUMMARY OF THE INVENTION

It is an object of the present invention to control the oil jet and oxygen flow to extinguish oil well fires.

The method of the present invention allows the oil jet to disburse to the walls of cylinder resulting in the reduction of the velocity of the oil to a point where it will then flow down the sides of the cylinder by gravity resulting in a more efficient and quick method without the use of chemicals. The method for the extinguishing of oil well fires of the current invention utilizes a steel cylinder which contains in the inside a series of square mesh screens which allows the oil jet to disburse through the walls of the cylinders and as a result reduces the velocity of the oil jet to a point where it will flow down the sides of the cylinder by gravity. This method of the present invention also incorporates a flapper valve attached to the cylinder which allows gases to escape without allowing oxygen to enter.

The method of the present invention utilizes a steel cylinder, inside of which are a series of mesh screens, preferably square mesh, spaced and arranged in an overlapping manner so that the oil jet will be slowed by impact with the mesh and thereby ultimately disbursed to the outside walls on the cylinder so that it does not form a spray or mist in an open oxygen atmosphere. Once the velocity of the flow of oil is reduced, the oil jet will then dissipate and the oil flow downwards by gravity. This cylinder also has a flapper valve placed in a swayed portion on top of the velocity reducer section at the top of the cylinder. The flapper acts as a check valve and prevents oxygen from entering the cylinder and at the same time allows any gases that may be under pressure to escape. In order to keep the outside wall of the cylinder sufficiently cooled and prevent the oil flowing out of the base of the cylinder from vaporizing and igniting, water may be pumped through a collar around the cylinder and sprayed on the cylinder through holes directed at the cylinder for cooling. This collar may also have holes directing some spray to the surrounding area to assist extinguish any remaining ground fire.

If a helicopter is used for the placement of the extinguisher cylinder over the well fire, a forked device with open hooks on each end could be attached to a cable with a closed hook on the top end. If a boom is used, a similar forked device could be made, which would have U-hooks and be attached to the boom.

DESCRIPTION OF THE DRAWINGS

For further understanding of the nature and object of the present invention, reference should be made to the description of the preferred embodiments in the following drawings in which like parts are given like reference numerals and wherein.

DESCRIPTION OF THE PREFERRED EMBODIMENTS

Referring to FIG. 1, there is shown a round steel cylinder which is preferably constructed of ¼-inch boiler plate but may be made of any suitable material. On top of the cylinder 1 is placed a cylindrically shaped reducer 2 which is preferably also fabricated of ¼-inch boiler plate but may be made of any suitable material, the diameter of which is approximately three-fourths of the diameter of the cylinder 1 and the length of the reducer 2 is approximately one-fourth of the length of the cylinder 1. Reducer 2 includes a flange (not shown) at the bottom which is sized to fit the outside diameter of the cylinder 1. The flange is welded to the cylinder 1.

Figure 1A:
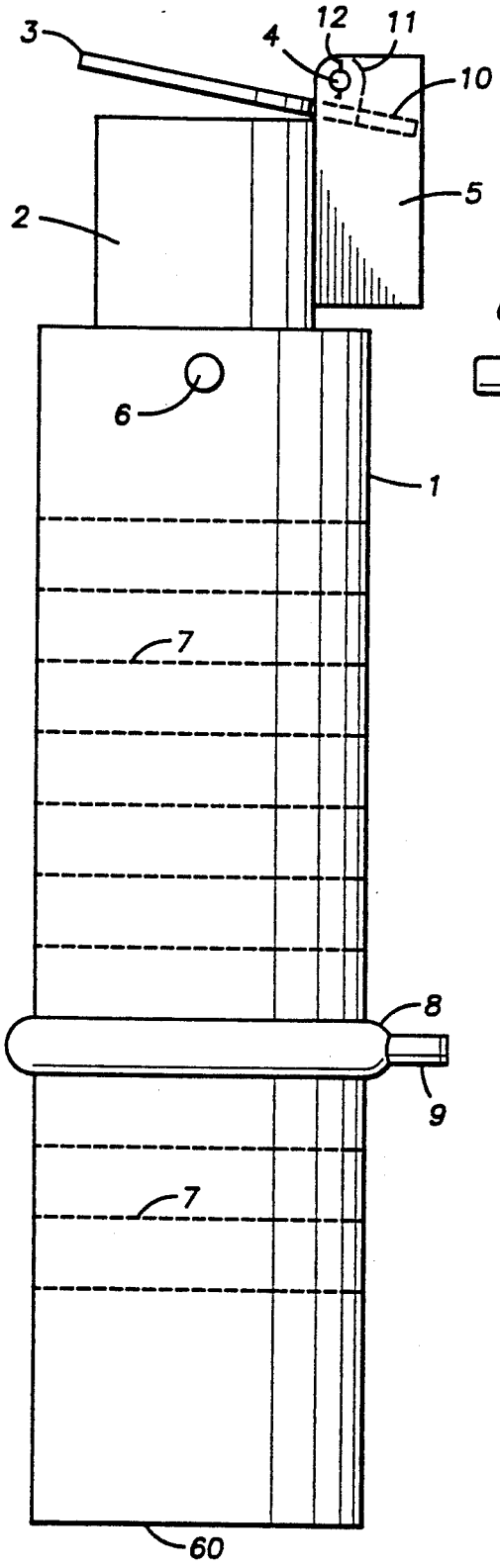
FIG. 1A is a side view of the cylinder of the preferred embodiment of the present invention partially in phantom line.
Figure 1B:
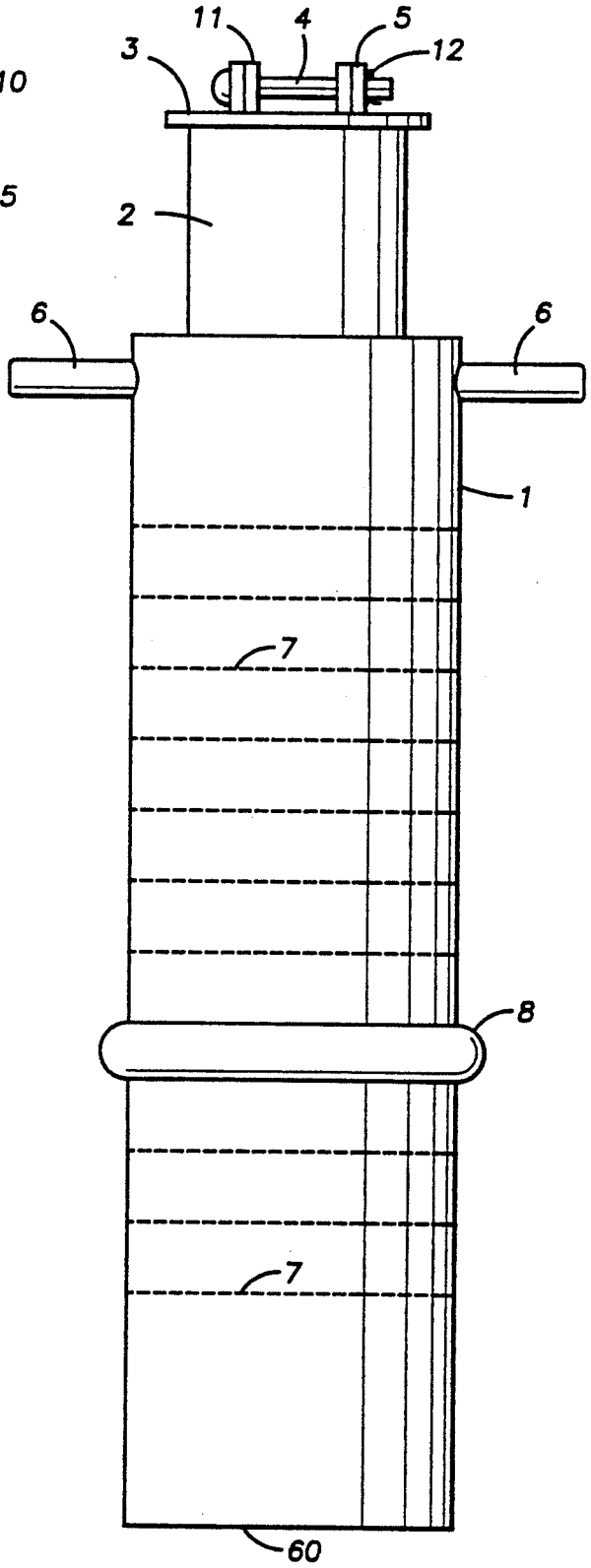
FIG. 1B is a back view of the cylinder of the preferred embodiment of the present invention partially in phantom line (FIGS. 1A and 1B sometimes hereinafter referred to as "FIG. 1"

As shown in FIGS. 1A, 1B and 17, reducer 2 closes the top of cylinder 1 by a substantially horizontal number.

A round flapper valve piece 3 which is preferably made of steel, but may be made of any suitable material, is mounted at the top of the reducer 2, and sized to cover the upper opening of the reducer 2. The flapper valve piece 3 includes an extended arm 10 with a sleeve 11 welded across the width of the arm 10 slightly displaced from the position that arm 10 joins flapper valve piece 3.

Two brackets 5 are welded to the side of the reducer 2 spaced apart sufficiently to permit the arm 10 to fit between them. Corresponding holes 50 are provided at the top of each bracket 5 positioned so that they will line up with the sleeve 11 on the arm 10 when arm 10 fits between brackets 5. These holes 50 are sized, as is sleeve 11, to receive a pin 4 placed through the hole in one bracket 5, through the sleeve 11, and through the hole in the other bracket 5 when arm 10 fits between brackets 5. The pin 4 has an opening (not shown) sized to relieve a cotter pin 12 therein to secure pin 4 in place after insertion. The flapper valve piece 3 is thus hinged to reducer 2 which will then be able to open by gas pressure and close by gravity. A spring (not shown) may be provided to bias the flapper valve piece 3 to prevent opening prior to the interior pressure in the cylinder reaching a level preset by the spring bias and weight of the flapper valve piece 3. The arm 10 of the flapper valve piece 3 is sized to extend sufficiently far so that it will hit the side of the reducer 2 when fully opened. This will create a stop, and the flapper valve piece 3 accordingly will close by gravity acting on the weight of the flapper valve piece 3 when there is not gas pressure sufficient to hold the flapper valve piece 3 away from reducer 2 being released.

Figure 3A:
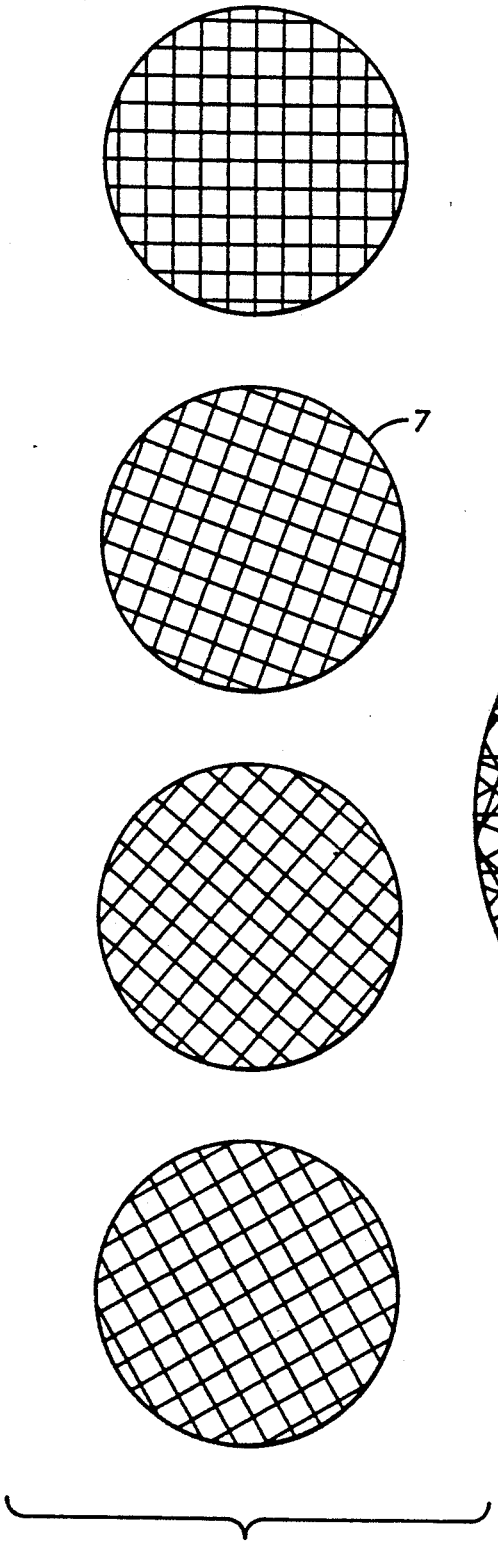
FIG. 3A is a plan view of several mesh screens and FIG. 3B is a set of mesh screen of FIG. 4.

A series of mesh screens 7 are placed in the interior of cylinder 1. The screens 7 are preferably fabricated of mild steel and have 4 inch squares with 0.225 diameter wire but may be made of any suitable material. As illustrated in FIG. 3, screens 7 are spaced and arranged in such a way that an oil jet (not shown) will be disbursed to the interior walls of the cylinder 1, where with its upward velocity deflected, it will then flow downwards by gravity. To accomplish this, the screens 7 are preferably cut round to the approximate inside diameter of the cylinder 1 and mounted on cylinder sections or bands 14 which are stacked and sized to snugly fit in the interior of the cylinder 1. All screens 7 may be fabricated to be substantially identical. The screens 7 are spaced and arranged one above the other as shown in FIG. 4 within the cylinder 1 at intervals determined by the length of the cylinder 1 used and the length of bands 14.

Figure 3B:
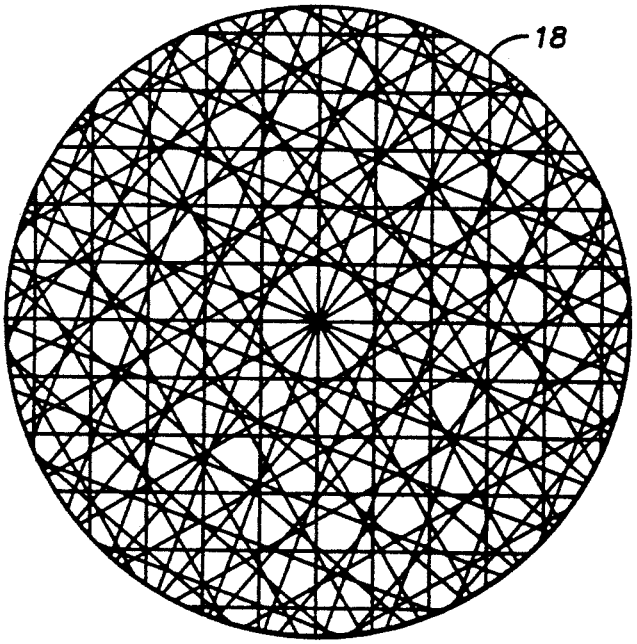

The first screen 7 is placed approximately one-fourth of the way up from the bottom 60 of the cylinder 1 as seen in FIG. 1A. The mesh of the second screen 7 will be rotated approximately twenty degrees to the right of the first screen 7. Each subsequent screen 7 will be rotated an additional approximately twenty degrees to the right of the one preceding it. For this purpose, in fabricating screens 7, it is important that there be a center point of intersection of the square mesh screen 7 at the center of the cylinder 1. Referring to FIG. 3B, screens 7 will thus be layered until a three hundred and sixty degree rotation has been reached as indicated by indicator 18 of FIG. 3B. The screens 7 may also be arranged and rotated differently so long as their combined function of dispersing the flow of oil to the walls of the cylinder 1 by impact with the screen material is not impaired. Also round or other shaped wire screen should be used rather than square.

Figure 4A:
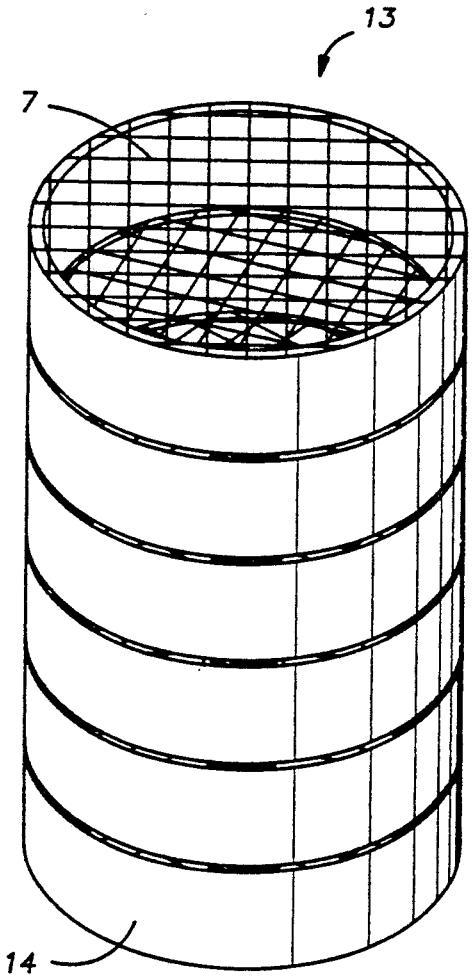
FIG. 4A is a side view of the prefabricated square mesh screen assembly of FIG. 1.
Figure 4B:
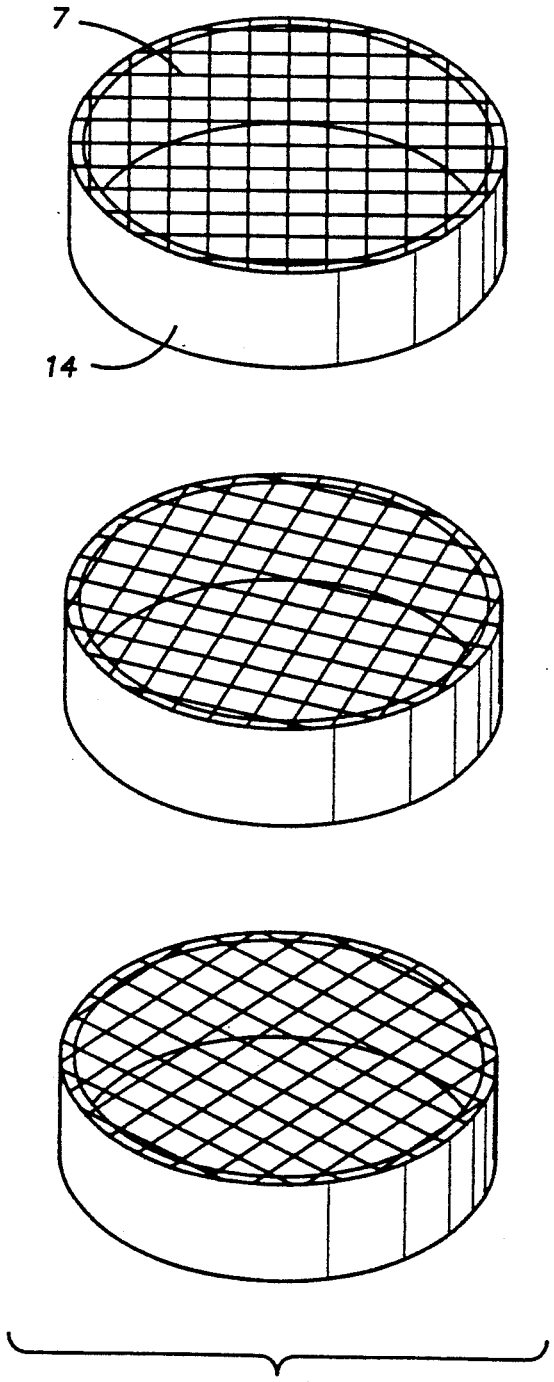
FIG. 4B is an exploded, partial view of the prefabricated square mesh screens of the prefabricated assembly of FIG. 1 (FIGS. 4A and 4B sometimes referred to hereinafter s "FIG. 4")
Figure 5D:
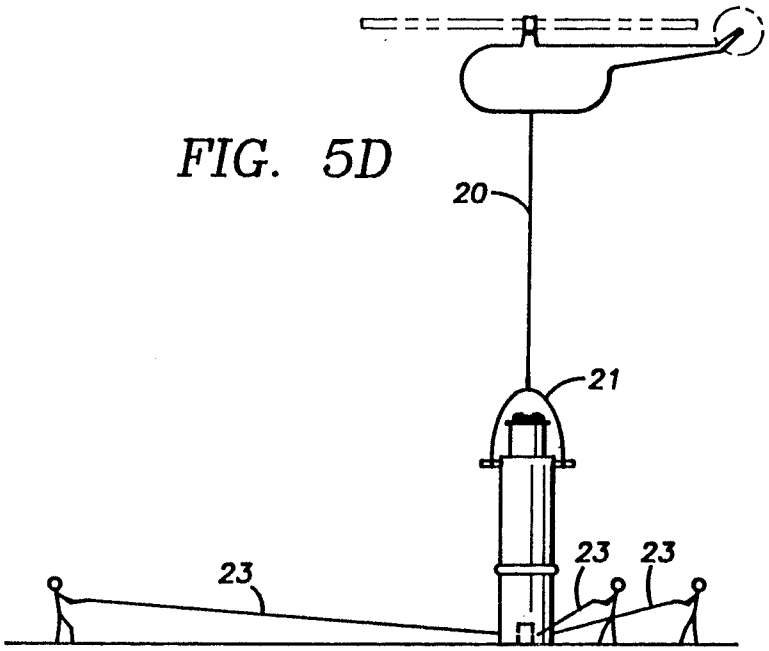
FIG. 5A and FIG. 5D illustrate a set of two sequential diagrams of the placing of the extinguisher of the preferred embodiment of the present invention over an oil well fire.
Figure 5C:
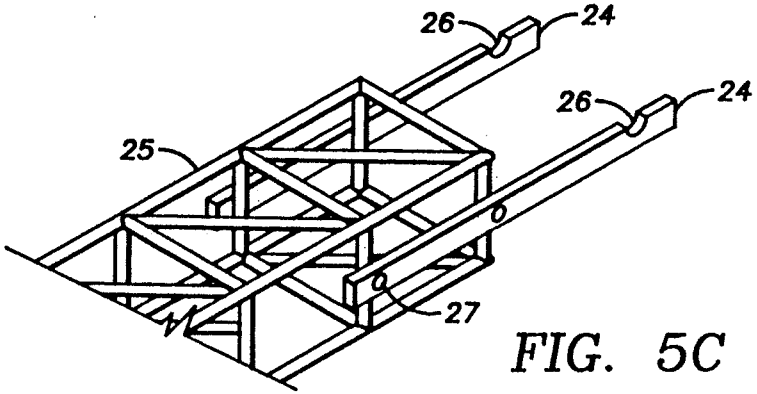
FIG. 5C is a side view of a connection assembly for cranes for use with the extinguisher of the preferred embodiment of the present invention.
Figure 5A:
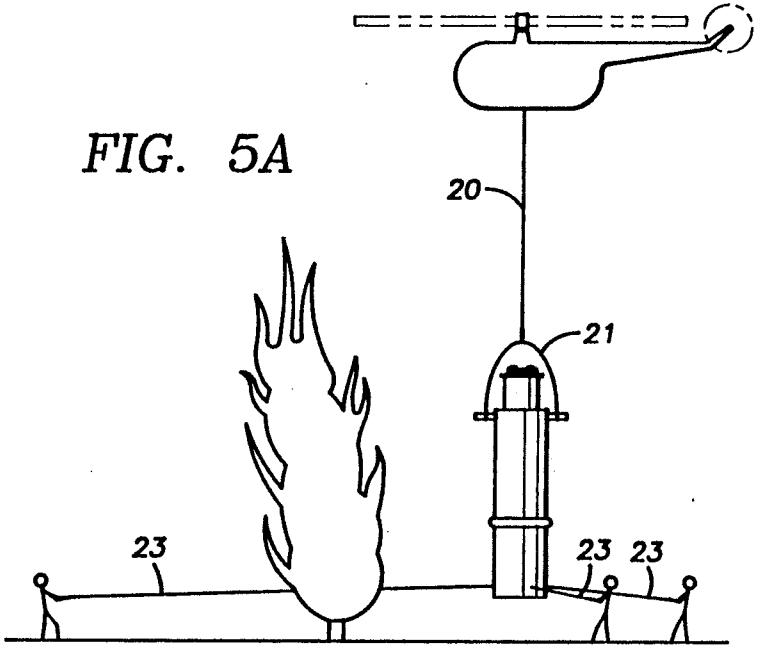
Figure 5B:
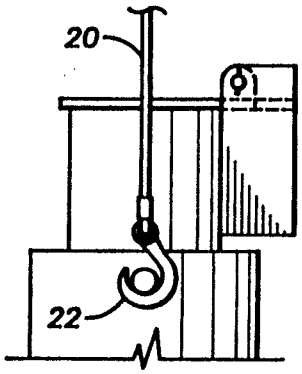
FIG. 5B is a side view of the connection of the extinguisher with the hooks of the helicopter in place.

Referring to FIG. 4, the prefabricated square mesh screen assembly 13 is made by preparing a series of metal bands 14. The width of the bands 14 will determine the spacing of the screens 7 as discussed above. This spacing can be varied depending on the pressure and size of the oil jet. Also discussed above, the diameter of bands 14 will be sized so that they can snugly slide into the cylinder 1. The first band 14 will have square mesh screen 7 spot welded to the bottom of it, then another screen 7 spot welded to the top of it. Each additional band 14 will also have a screen 7 spot welded to the top of it. After being spot welded, the screen 7 should be trimmed even with the outside diameter of the bands 14. The same sequence of rotating the screens 7 as previously described should be used. These bands 14 with screens 7 are welded together to form one unit which will then be inserted into the cylinder 1. The unit can be secured to the cylinder 1 by self tapping bolts (not shown) or by welding (not shown). This prefabricated screen assembly 13 is preferred to the alternative method of welding (not shown) each individual screen 7 to the inside diameter of the cylinder 1.

Figure 2A:
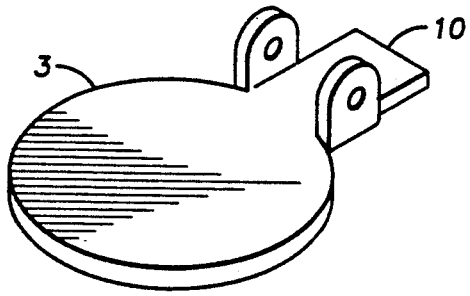
FIG. 2A is a plan view of the flapper.
Figure 2B:
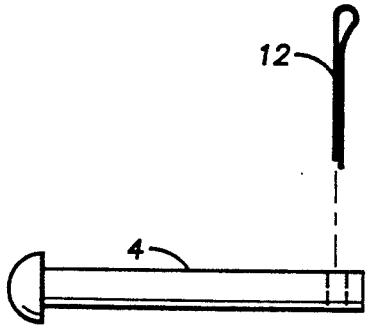
FIG. 2B is a side view of the bracket.
Figure 2B:
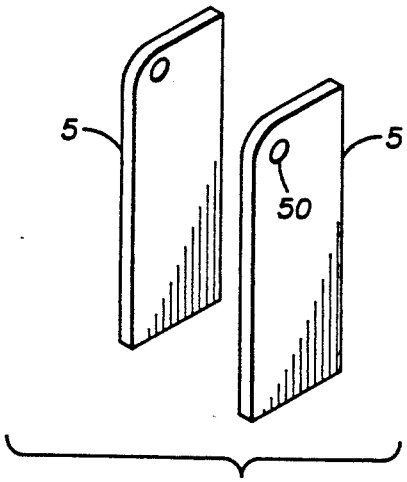
Figure 2D:
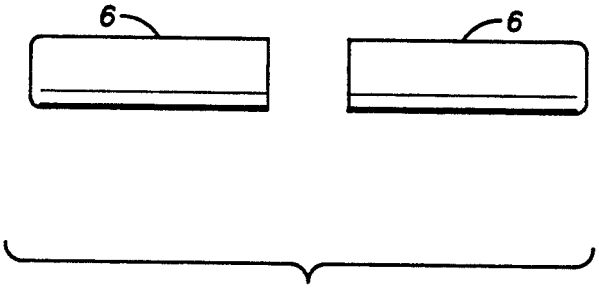
FIG. 2D is a side view of various pieces of the preferred embodiment of the present invention partially in phantom line (FIGS. 2A, 2B, 2C and 2D sometimes hereinafter referred t as "FIG. 2"
Figure 2C:
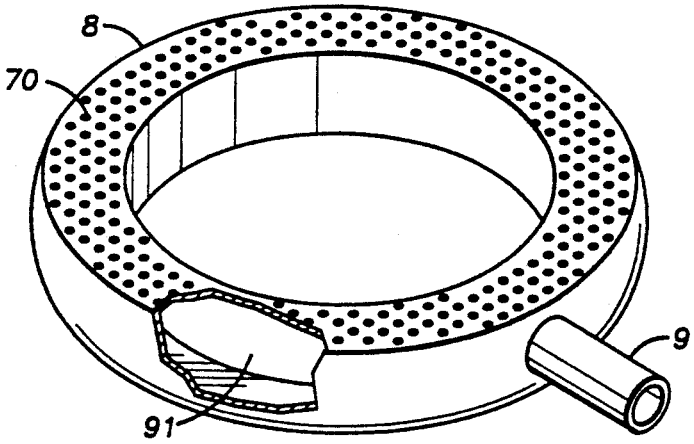
FIG. 2C is a top view of the collar.

A hollow metal collar 8 is secured around the cylinder 1 to act as a heat exchanger. The outside wall of the cylinder 1 is kept sufficiently cooled by water flowing through the hollow portion 91 (shown in FIG. 2C as a view of the interior of collar 8 with no physical opening being intended in the side of collar 8) of collar 8 to cool the oil flowing down the sides of cylinder 1 to prevent the exiting oil flowing out of the base of the cylinder 1 from vaporizing and igniting. Water will be pumped through the collar 8 and may also be sprayed on the cylinder 1 through holes 70 directed at the cylinder 1. Collar 8 may also have holes (not shown) directing some spray to the surrounding area to assist extinguishing any remaining ground fire. Inlet 9 provides water to collar 8.

Figure 6A:
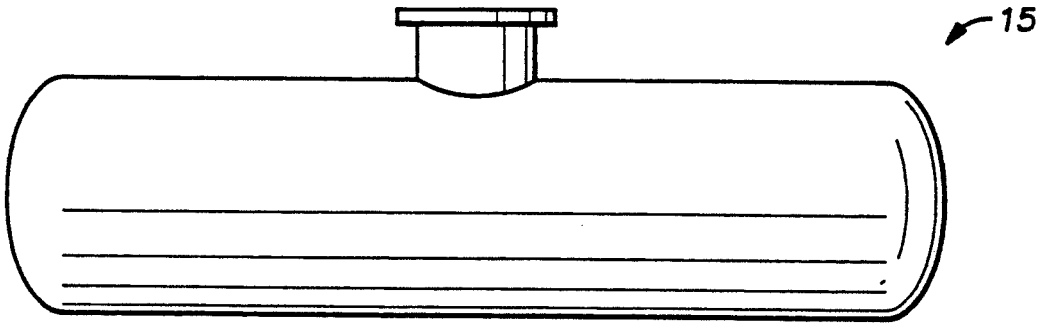
FIG. 6A, FIG. 6B, and FIG. 6C show (FIGS. 6A, 6B and 6C hereinafter sometimes referred to as "FIG. 6") shows a sequence of modifications to a propane tank to convert it to the extinguisher of the preferred embodiment of the present invention.
Figure 6B:
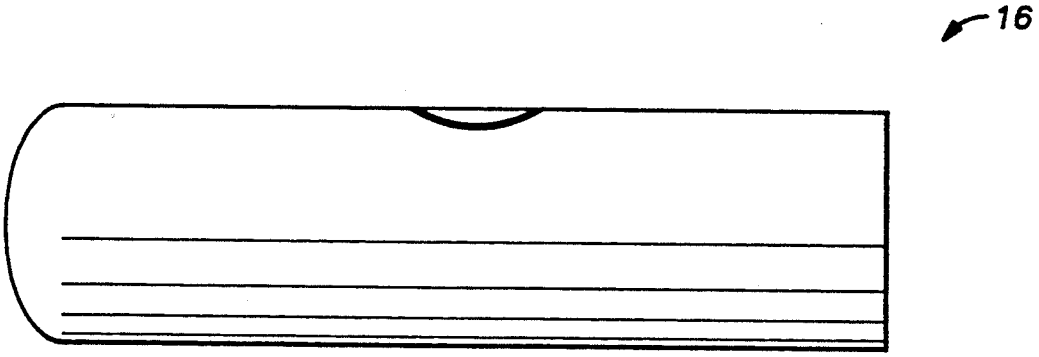
Figure 6C:
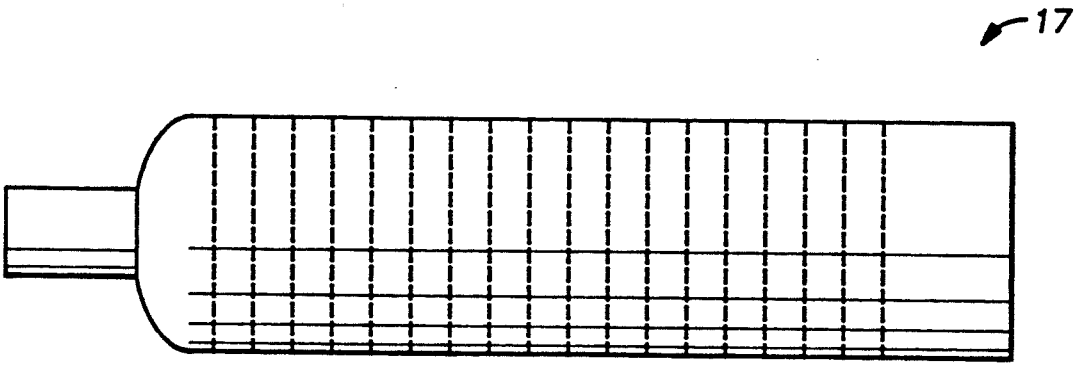

Referring to FIG. 6, there is shown the manner in which an existing tank can be adopted in order to expedite the fabrication of this invention. An existing tank such as a propane or other metal fuel tank ? 5 could be used with some alternations 16 for the cylinder 1. The tank should be made of steel of suitable thickness for physical strength and at least twelve feet long and between four and five feet in diameter to provide adequate room for the placement of for example eighteen screens 7 (twenty degree displacement) spaced at for example six inch intervals 17.

Referring to FIG. 1, pins 6 are located on either side of the cylinder and sized to facilitate the placement of the extinguisher over an oil well fire. If the extinguisher will be placed over an oil well fire by placing it at a point adjacent to the source of the jet, then the cylinder 1 must be moved over the jet and lowered to its lowest point. After the placement of cylinder 1 over the fire, if the base 60 of the cylinder 1 is flush with the ground, the fire having already been extinguished, the oil will build up the cylinder and force the gasses in the cylinder 1 to escape through the flapper valve piece 3. This will prevent pressure from building in the cylinder 1 and any fire existing around the cylinder 1 should be extinguished before removing the extinguisher. The displacement should be done as quickly as possible in order to prevent the cylinder 1 from overdue exposure to the fire which could result in overheating.

FIGS. 5 and 1 illustrate the manner in which the helicopter can be used for the placement of the cylinder 1 by the use of a steel cable 20 with a fork device 21 at one end. Fork device 21 may be made out of round stock mild or cold rolled steel approximately one inch in diameter or other suitable material, and tines long enough to fashion two open hooks 22 on each end. The hooks 22 should be sized to fit loosely around the pins 6 of the cylinder 1.

Four steel cables 23 should be secured near the base 60 of the cylinder 1. These cables 23 should be long enough so that the men holding the cables 23 on the ground can walk around the oil well fire and position themselves to assist in the proper placement of the extinguisher over the oil well. Thus, the cylinder 1 is suspended away from the fire and the cables 23 deployed. The cylinder 1 is then lowered over the fire as discussed above.

A boom 25 could also be used to lower the extinguisher over an oil well fire such as by a crane. Two pieces of for example strap iron 24 approximately three inches wide and one inch thick are secured to the boom 25 by bolting 27, or by welding (not shown). Strap 24 is shaped to fit around the diameter of the pins 6 of cylinder 1. The end of each strap 24 including a U-shaped cut-out 26 approximately one and one-fourth inch deep, for example. The cut-out 26 receive the pins 6 on the cylinder 1. The cylinder 1 as assembled can then be lifted and placed over an oil well fire.

It will be appreciated that many other modifications and improvements to the disclosure herein may be made without departing from the scope of the invention or the inventive concepts herein disclosed. Because many varying and different embodiments may be made within the scope of the inventive concept herein taught, including equivalent structures or materials hereafter thought of, and because many modifications may be more in the embodiments herein detailed in accordance with the descriptive requirements of the law, it is to be understood that the details herein are to be interpreted as illustrative and not in a limiting sense.

What is claimed as the invention is:

1. A fire extinguisher for an oil well fire having an oil jet comprising:

a cylinder having a top and a bottom with an interior and exterior and being open at said top and said bottom;

a cylindrical reducer mounted on said top of the cylinder and closing said top of said cylinder by a substantially horizontal member, said reducer having an exterior, an upper end and being open at said upper end;

a flapper valve having a normally closed, pressure actuated flapper valve piece, said valve piece rotatably mounted on said upper end of said reducer; and a series of steel mesh screens mounted in said interior of said cylinder, whereby a pressure and flow of the oil jet are reduced through said series of the steel mesh screens.

2. The apparatus of claim 1, wherein said cylindrical reducer has a diameter and said cylinder has a different diameter, and said diameter of said reducer is approximately three-fourths of the diameter of said cylinder.

3. The apparatus of claim 1, wherein said cylindrical reducer has a length and said cylinder has a different length, and said length of said reducer is approximately one-fourth of that of said cylinder.

4. The apparatus of claim 1, wherein said flapper valve piece includes a round section sized to cover said upper end of said reducer.

5. The apparatus of claim 4, wherein said flapper valve further includes an extended arm depending from said flapper valve piece.

6. The apparatus of claim 5, wherein said flapper valve piece has an outer diameter and said extended arm includes a sleeve mounted on said arm at a point just beyond the outer diameter of said flapper valve piece.

7. The apparatus of claim 6, wherein there is further included two brackets, one of said brackets being mounted on each side of said cylindrical reducer and spaced so that said arm fits between them.

8. The apparatus of claim 7, wherein each of said brackets has a top, and said top of each of said brackets is positioned so that said brackets will line up with said sleeve on said arm.

9. The apparatus of claim 8, wherein there is further included a pin, and openings are formed in the top of each of said brackets sized to receive said pin.

10. The apparatus of claim 5, wherein said arm is of sufficient length to hit the exterior of said cylindrical reducer when said flapper valve piece is farthest from covering said top of said cylindrical reducer, whereby a stop is created.

11. The apparatus of claim 1, wherein said series of the steel mesh screens includes substantially identical screens spaced from each other and said series of the steel mesh screens include diverting means for dispersion of the oil jet to the interior of said cylinder.

12. The apparatus of claim 11, wherein said cylinder has an inside diameter and a length and said screens are round and sized to fit within said inside diameter of said cylinder and spaced and arranged one above the other within said cylinder at intervals determined by said length of said cylinder.

13. The apparatus in claim 11, wherein said mesh screens are layered on top of each other to a three hundred and sixty degree rotation.

14. The apparatus of claim 1, wherein said cylinder has an exterior wall and there is further included a hollow metal collar mounted on said exterior wall of said cylinder.

15. The apparatus of claim 14, wherein said hollow metal collar is sized to receive pumped water and said metal collar includes openings formed to spray on said cylinder.

16. The apparatus of claim 1, wherein pins are located on either side of said cylinder to facilitate placement of the extinguisher over the oil well fire.

17. A fire extinguisher for an oil well fire having an oil jet comprising:

a cylinder having a top and a bottom and an interior and being open at said top and said bottom;

a cylindrical reducer mounted on said top of the cylinder and closing said top of said cylinder, said reducer having an upper end and being open at said upper end;

a flapper valve having a flapper valve piece, said valve piece rotatably mounted on said upper end of said reducer; and a series of steel mesh screens mounted in the interior of said cylinder;

wherein said series of the steel mesh screens includes substantially identical screens spaced from each other and said series of the steel mesh screens include diverting means for dispersion of the oil jet to the interior of said cylinder;

wherein said cylinder has an inside diameter and a length and said screens are round and sized to fit within said inside diameter of said cylinder and spaced and arranged one above the other within said cylinder at intervals determined by said length of said cylinder; and wherein there is a first mesh screen having mesh of said series of the steel mesh screens and having a first orientation of said mesh, said first screen is placed approximately one-fourth of the length of said cylinder from the bottom of said cylinder, there is a second mesh screen of said series of the steel mesh screens which has mesh, and said mesh of said second screen will be rotated approximately twenty degrees from said orientation of said mesh of said first screen.

18. The apparatus of claim 17, wherein there are succeeding screens having mesh and orientation thereof of said series of the steel mesh screens above said first mesh screen and said second mesh screen, each of said succeeding screens is rotated approximately twenty degrees from the orientation of said mesh of the preceding on of said screens.

19. A fire extinguisher for an oil well fire having an oil jet comprising:

a cylinder having a top and a bottom and an interior and being open at said top and said bottom;

a cylindrical reducer mounted on said top of the cylinder and closing said top of said cylinder, said reducer having an upper end and being open at said upper end;

a flapper valve having a flapper valve piece, said valve piece rotatably mounted on said upper end of said reducer; and a series of steel mesh screens mounted in the interior of said cylinder;

wherein said series of the steel mesh screens includes substantially identical screens spaced from each other and said series of the steel mesh screens include diverting means for dispersion of the oil jet to the interior of said cylinder; and wherein said cylinder has a center and there is a center point of intersection of each of said mesh screens at said center of said cylinder.

* * * * *